United States Patent [19]

Weber

[11] Patent Number: 4,684,058

[45] Date of Patent: Aug. 4, 1987

[54] CARTON WITH POUR SPOUT

[75] Inventor: Frank J. Weber, St. Louis, Mo.

[73] Assignee: Ralston Purina Company, St. Louis, Mo.

[21] Appl. No.: 866,117

[22] Filed: May 22, 1986

[51] Int. Cl.[4] ..... B65D 5/72

[52] U.S. Cl. ..... 229/17 R; 206/604; 206/631; 229/134

[58] Field of Search ..... 229/7 R, 17 R, 134; 206/604, 631, 629

[56] References Cited

U.S. PATENT DOCUMENTS

| | | | |
|---|---|---|---|
| 807,418 | 12/1905 | Cavanagh | 229/17 R |
| 1,698,699 | 1/1929 | Andrews | 229/134 |
| 1,714,363 | 5/1929 | Groner | 229/7 R |
| 2,007,553 | 7/1935 | Vincent | 229/7 R |
| 2,028,687 | 1/1936 | Read | 229/17 R |
| 2,029,888 | 2/1936 | Metzger | 229/17 R |
| 2,348,310 | 5/1944 | Rous | 229/17 R |
| 2,565,182 | 8/1951 | Maxon | 229/17 R |
| 2,969,904 | 1/1961 | Cottrill | 229/17 R |
| 3,057,533 | 10/1962 | Silver | 229/17 R |
| 3,281,054 | 10/1966 | Buttery et al. | 206/629 |
| 3,958,748 | 5/1976 | Smith et al. | 206/629 |

FOREIGN PATENT DOCUMENTS

| | | | |
|---|---|---|---|
| 92486 | 7/1958 | Norway | 229/7 R |
| 436107 | 11/1967 | Switzerland | 229/17 R |

*Primary Examiner*—Stephen Marcus
*Assistant Examiner*—Gary E. Elkins
*Attorney, Agent, or Firm*—Price, Heneveld, Cooper, DeWitt & Litton

[57] ABSTRACT

A carton formed from a unitary blank of paperboard includes a front panel, a rear panel and side panels joined to the front and rear panels along fold lines. Top and bottom closure flaps are joined to the front and rear panels. A pour spout is defined by one of the panels. The pour spout includes a generally triangular flap joined to the panel along an angled fold line. The triangular flap or area includes a lateral edge to which a closure tab or glue flap is joined. A dust flap is joined to a top edge of the triangular flap along a fold line. The dust flap defines a curved edge and a notch. The notch is positioned to engage a top edge of one of the panels to hold the spout in an open position. Glue is applied to one of the panels to engage the closure tab or glue flap to initially hold the spout in a closed position.

15 Claims, 4 Drawing Figures

CARTON WITH POUR SPOUT

BACKGROUND OF THE INVENTION

The present invention relates to cartons and blanks for forming cartons which have an integral pour spout.

Various granular or fluid dry products are packaged in paperboard or cardboard containers. These products include cereal, salt, sugar and other foods, as well as detergents or soap. Available cartons are generally formed from a blank of cardboard or paperboard. The blank may be die cut and scored to define fold lines. The fold lines separate the blank into various panels including front and rear panels, side panels, closure flaps and dust flaps.

Heretofore, various proposals have been made for providing pour spouts in such paperboard containers. In one approach, a metal insert is secured to one of the box panels. The metal insert increases the cost and difficulty of manufacture. The use of separate inserts, of course, requires secondary manufacturing operations. Various attempts have been made to provide a blank with an integral pour spout or closure. The pour spout or closure may be defined by perforation lines or additional, integral panels which are folded internally of the container. Problems are experienced with these types of containers in their manufacture and also their use. The spouts are not easily opened or readily closed. In addition, problems are experienced with holding the spout in an open position during use.

Examples of prior containers may be found in U.S. Pat. No. 4,216,864 entitled CONTAINER WITH AN INTEGRALLY FORMED SPOUT AND BLANK THEREFOR and issued on Aug. 12, 1980, to Austin, Jr.; U.S. Pat. No. 4,150,778 entitled CARTON WITH POUR SPOUT and issued on Apr. 24, 1979, to Engdahl, Jr.; and U.S. Pat. No. 3,989,171 entitled CARTON WITH POUR SPOUT and issued on Nov. 2, 1976, to Arneson.

The aforementioned U.S. Pat. No. 4,150,778 discloses a paperboard carton including front, rear and side panels. One of the side panels has a tear tab arranged to be torn loose and hinged outwardly to form a dispensing opening. An inner wall panel of the carton has an integral portion which forms a hinge spout member. A portion of the member is secured to the tear tab so that the member is pulled into the dispensing opening to form the pouring spout.

A need exists for a container formed from a one-piece or unitary die-cut blank which includes an integrally formed pour spout and which may be made with reduced material costs, without secondary operations and which overcomes the use problems set forth above.

SUMMARY OF THE INVENTION

In accordance with the present invention, the aforementioned needs are fulfilled. Essentially, the invention includes a container formed from a one-piece blank and having front, rear and side panels joined along fold lines. Top and bottom closures are joined to the front and rear panels. A pour spout is defined by one of the panels. The spout includes a generally triangular flap or portion joined to one of the panels along an angled fold line. A closure tab is hingedly joined to an edge of the triangular area. The flap is initially glued to a panel to hold the spout in a closed position. A dust flap is joined to another edge of the triangular flap or portion. The dust flap includes a curved edge which defines a notch.

The notch is positioned to engage a panel of the container to hold the spout in an open position.

The present invention provides a simple pour spout which eliminates the need for inserts or secondary manufacturing operations. The present invention increases the ease of use of the container and eliminates many of the problems heretofore experienced.

DETAILED DESCRIPTION OF THE PREFERRED EMBODIMENT

Figure 1:
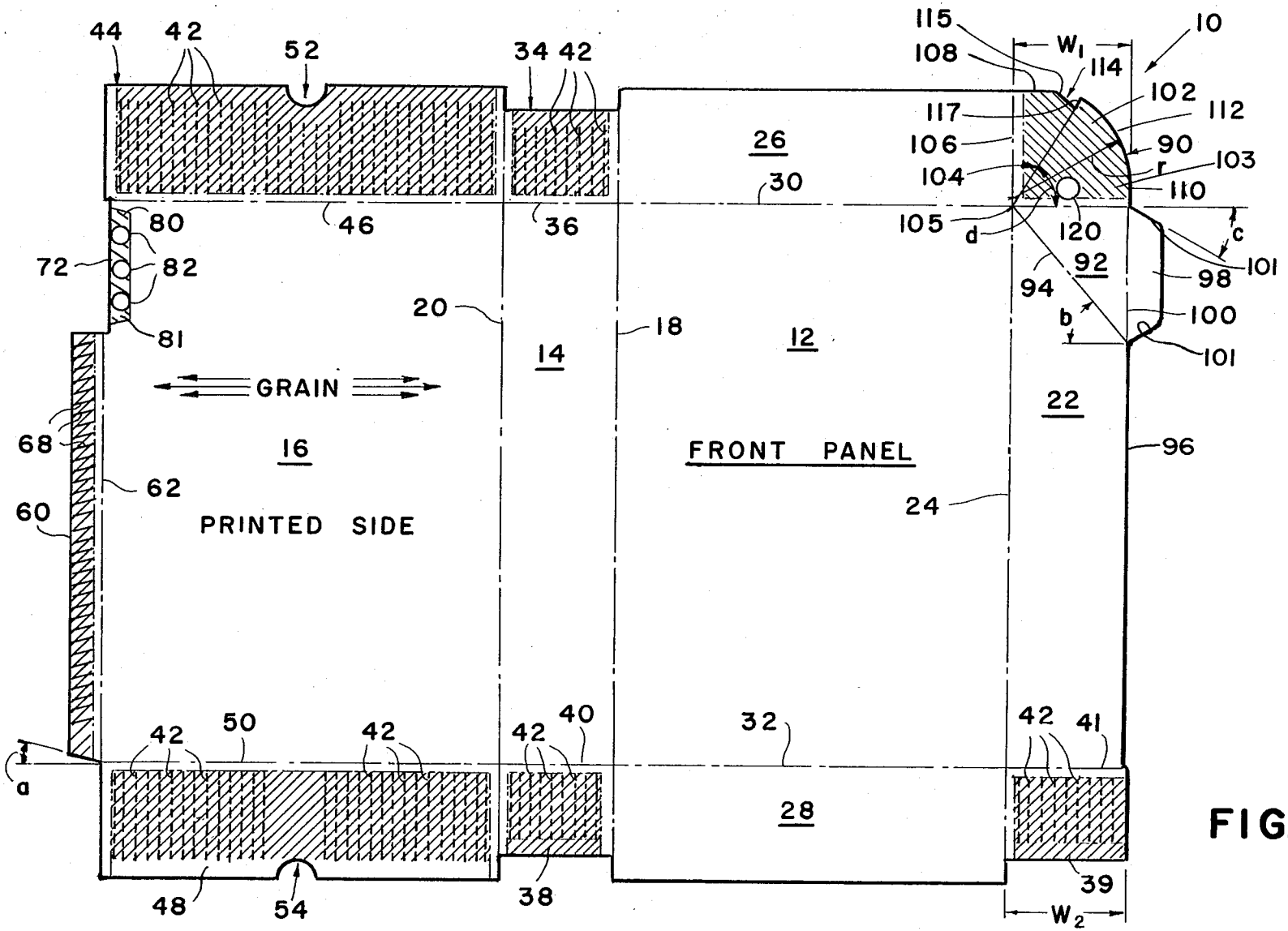
FIG. 1 is a top, plan view of a blank die cut from paperboard and which forms the carton accordance with the present invention.

A die-cut blank of paperboard or cardboard for forming a carton or container in accordance with the present invention is illustrated in FIG. 1 and generally designated by the numeral 10. Blank 10 includes a front panel 12, a side panel 14 and a rear or back panel 16. Panels 12 and 16 are joined to side panel 14 along hinge or fold lines 18, 20, respectively. Joined to front panel 12 is another side panel 22. Side panel 22 is joined to a lateral edge of panel 12 along a hinge or fold line 24. A top closure flap 26 and a bottom closure flap 28 are joined to panel 12. Flap 26 is joined to a top edge of panel 12 along a fold line 30. Bottom closure flap 28 is joined to a lower edge of panel 12 along a fold line 32. Side panel 14 has an upper dust flap 34 joined thereto along a hinge line 36. Panel 14 further includes a lower dust flap 38 joined thereto along a fold line 40. A dust flap 39 is joined to a lower edge of panel 22 along a fold line 41. Dust flaps 34, 38 and 39 include a plurality of glue perforation lines 42. In an existing embodiment, the glue perforation lines are formed in a generally rectangular area approximately ⅛" from the edges of the dust flap. The glue perforation lines are approximately 1/16" in length and are die cut 50% through the paperboard.

Rear panel 16 includes a top closure flap 44 joined to an upper edge of panel 16 by a hinge line 46. A lower closure flap 48 is joined to a lower edge of panel 16 along a hinge line 50. Panels 44, 48 also include a plurality of spaced, glue perforation lines 42. Flaps 44, 48 also define semicircular notches 52, 54, respectively. Notches 52, 54 are used by the conventional automatic machinery which folds the blank in a conventional fashion.

Joined to a free lateral edge of rear panel 16 is a securement or glue flap 60. Flap 60 is joined to panel 16 along a hinge line 62. A lower edge 64 of flap 60 is angled upwardly at an angle "a", as shown in FIG. 1. In an existing embodiment, angle "a" is approximately 10 degrees. The lower edge is angled for ease of assembly. Flap 60 includes a plurality of glue perforation lines 68. An upper corner of rear panel 16 defines an inwardly spaced edge or notch 72. Edge 72 is spaced inwardly from fold line 62. In an existing embodiment, the inward spacing is approximately 1/16". Immediately adjacent edge 72 is a generally rectangular area 80. In the preferred form, area 80 is coated with a commercially available glue repellant ink 81. Acceptable inks are presently sold in the United States by Borden under the number 5HGL11823C, by Kohl-Madden under the number MSP28365, and by Bowers under the number IP2012CR. As illustrated, three spaced circular areas or glue release dots 82 are die cut or formed in rectangular area 80. Dots 82 are unprinted or not coated with the glue repellant ink. These areas form the glue attachment points for the pour spout, as explained in more detail below. In an existing embodiment, dots 82 are die cut 50% through the blank.

The pour spout in accordance with the present invention is generally designated 90 in FIG. 1. Pour spout 90 includes a generally triangular flap or portion 92 which is hingedly joined to side panel 22 along a fold line 94. Fold line 94 extends from a lateral edge 96 of panel 22 at an angle "b" of approximately 45 degrees to an upper corner of flap 22 adjacent fold line 24. Joined to triangular portion 92 is a closure tab or glue flap 98. Tab 98 is hingedly connected to portion 92 by a fold line 100. Tab 98 has edges 101 which are angled from horizontal at an angle "c" of approximately 25 degrees. As described in more detail below, closure tab 98 is dimensioned to overlie area 80 formed on rear panel 16.

A dust flap or second pour spout member 102 is hingedly connected to an upper edge of portion 92 along a fold line 104. Flap 102 includes an edge 106 which is perpendicular to fold line 104 and a pair of straight edge portions 108, 110. Edge portions 108, 110 are joined by a curved portion 112. Curved portion 112 defines a notch 114 having edges 115 and 117. As explained in detail below, notch 114 holds the pour spout in an open position during use. Flap 102 is coated with glue repellant ink 103 in an area indicated by hatch marks and which is spaced from edge 106 and fold line 104. A circular glue release dot 120 is formed adjacent fold line 104 within this coated area. Dot 120, as with dots 82, is die cut 50% through the blank. Glue applied to the dot holds the dust flap secure, and along with tab 98 keeps the spout closed during shipment.

Blank 10 is die cut from laminated paperboard having a top liner or the like using conventional manufacturing techniques. The hinge or fold lines are scored in the blank. In scoring the blank, the paperboard is not cut through. In an existing embodiment, dust flap 102 and panel 22 have a width "$w_1$" of 1 25/32 inches. Dust flap 39 has a width "$w_2$" of 1 13/16 inches. Edge 112 has a radius of curvature "r" of $1\frac{7}{8}$ inches from a center point 3/16 inch from corner 105. Notch 114 has its edge 117 at an angle "d" of 60 degrees from corner 105.

Figure 2:
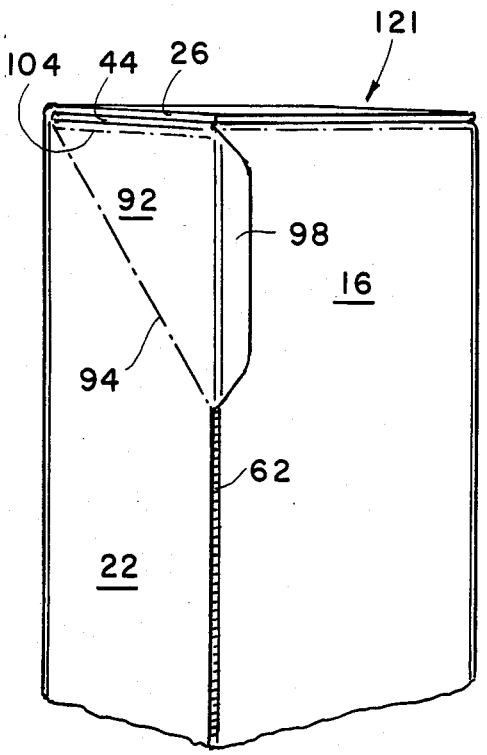
FIG. 2 is a perspective view of a container formed from the blank of FIG. 1 with the spout in the initial closed and sealed position.
Figure 3:
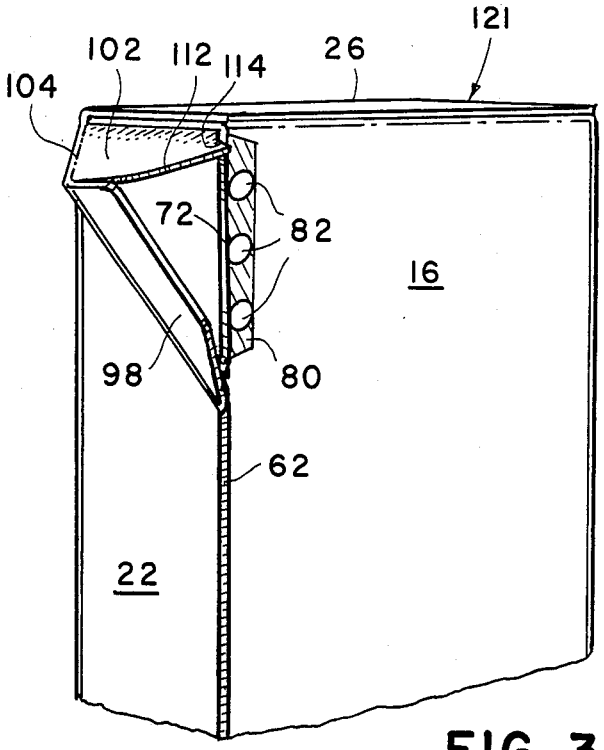
FIG. 3 is a perspective view of the container with the spout in the open, pouring position.
Figure 4:
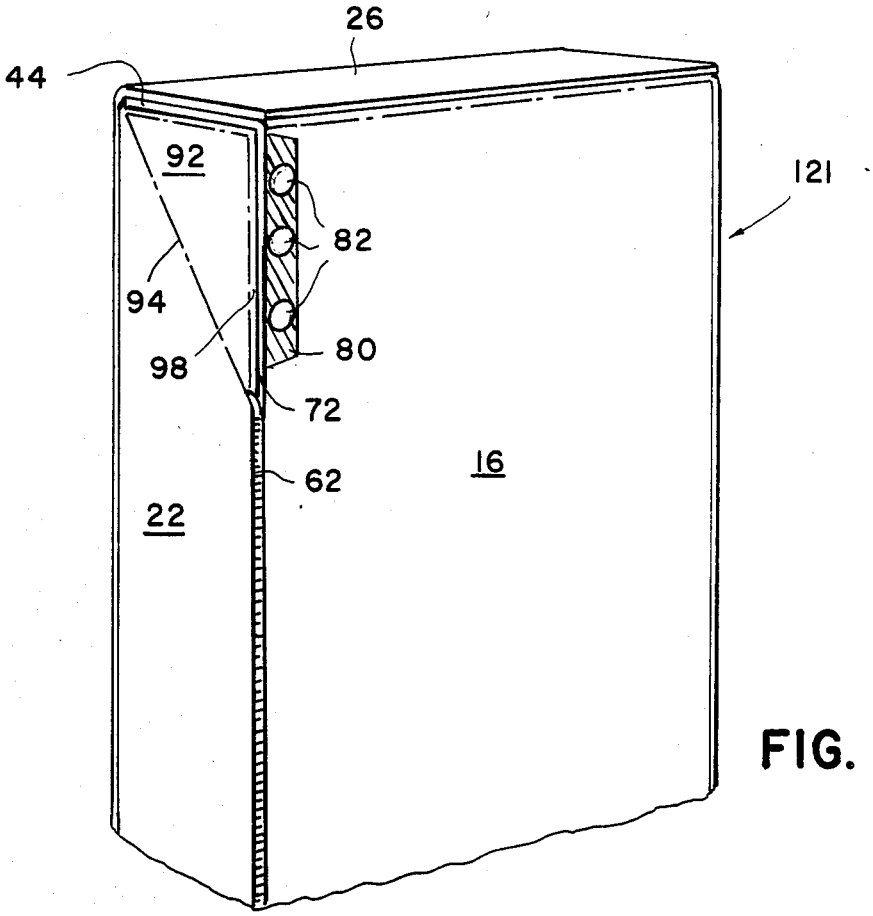
FIG. 4 is a perspective view of the container with the spout closed after being initially opened.

Automated machinery may be used to fold the blank 10 to form a carton generally designated 121 in FIGS. 2, 3 and 4. Initially, the blank is folded along fold lines 18, 20, 24 and 62. Glue applied to the securement or glue flap 60 attaches the flap to an inner surface of flap 22 adjacent edge 96. Glue applied to dust flap 38 joins flap 38 to an undersurface of closure flap 48. Closure flap 28 is secured to closure flap 48 by the glue applied to the top surface of flap 48. Dust flap 39 is secured to closure flap 48 by suitable glue or adhesive. When so folded, the top of the carton is open. The carton may be filled with product using conventional techniques.

After the carton is filled, flaps 44 and 34 are folded along their respective fold lines and flap 34 is secured to the undersurface of flap 44 by a suitable glue. Dust flap or pour defining member 102 is folded along its fold line 104 and secured to the undersurface of flap 44 at glue release dot 120. Top closure flap 26 joined to front panel 12 is then folded and secured to closure flap 44. Closure tab 98 is folded along hinge line 100 and secured to area 80 by glue applied to circular dots or portions 82.

Since glue secures closure tab 98 to the rear panel at only selected areas underneath the closure tab, the user may grasp the tab to pull it away from the rear panel. Since dots 82 are die cut, these circular areas of the top liner will separate from the rear panel and remain permanently attached to tab 98. The user then continues to pull outwardly on the tab. Triangular portion 92 pivots along hinge line 94. Flap 102 releases at glue release dot 120 and opens outwardly with edge 112 engaging the inner surface of rear panel 16 along its upper edge. Flap 102 is dimensioned, and the radius of curvature of edge 12 is selected so that this contact is maintained as the flap pivots outwardly. The spout is opened, as shown in FIG. 3, until notch 114 is reached. Notch 114 receives the upper corner of panel 16 and holds the spout in an open position. This positive retention of the pour spout significantly increases the ease of use of the container. The smooth inner surface of triangular portion 92 assures ease of pouring during use.

The pour spout is easily closed, as illustrated in FIG. 4. Flap 102 is pushed inwardly or panel 16 is pushed outwardly until notch 114 is cleared. Portions 92, 102 are then pushed back towards the box until portion 92 is substantially flush with side panel 22. Closure tab 98, as illustrated in FIG. 4, is inserted into the interior of the box. The friction between the closure tab and the inner surface of rear panel 16 holds the pour spout in a closed position. The notched area 72 of rear panel 16 is dimensioned to receive tab 98.

In view of the foregoing description, those of ordinary skill in the art will undoubtedly envision various modifications which would not depart from the inventive concepts disclosed herein. It is therefore expressly intended that the above description should be considered as only that of the preferred embodiment. The true spirit and scope of the present invention may be determined by reference to the appended claims.

The embodiments of the invention in which an exclusive property or privilege is claimed are defined as follows:

1. A container with an integrally formed pour spout, said container comprising:

a front panel, a rear panel and side panels joining said front and rear panels along fold lines;

top and bottom closure flaps joined to said front and rear panels;

a pour spout, said pour spout including a generally triangular flap joined to one of said side panels along an angled fold line, said triangular flap including a lateral edge and a top edge, a closure tab joined to said lateral edge along a fold line, and a dust flap joined to said top edge along a fold line, said dust flap defining a notch positioned to engage a top edge of said rear panel when the spout is in an open position; and a glue applied to an area of said rear panel and engaging a portion of said closure tab prior to opening said spout, said rear panel being joined to said one of said side panels by a securement flap, said securement flap terminating at said area and wherein said rear panel includes an offset lateral edge defining an inwardly spaced notch dimensioned so that said closure tab may be inserted inside of said container to reclose said pour spout.

2. A container as defined by claim 1 further including an area of glue repellant ink on said area of said rear panel and underlying said closure tab.

3. A container as defined by claim 2 wherein said dust flap of said pour spout is coated with a glue repellant ink and further includes an uncoated glue release dot.

4. A container as defined by claim 1 wherein said dust flap of said spout includes a curved edge which engages said top edge of said one of the panels to permit said flap to slide outwardly from under said top closure flap.

5. A container as defined by claim 3 wherein said dust flap of said spout includes a curved edge which engages said top edge of said one of the panels to permit said flap to slide outwardly from under said top closure flap.

6. A container as defined by claim 4 wherein said notch is in said curved edge of said dust flap of said spout.

7. A container as defined by claim 6 further including an area of glue repellant ink on said rear panel underlying said closure tab.

8. A one-piece, die-cut blank for forming a carton, said blank comprising:

a front panel;

a first side panel hingedly joined to said front panel along a fold line;

a second side panel hingedly joined to said front panel along another fold line;

a rear panel hingedly joined to said second side panel along another fold line;

a securement flap hingedly joined to said rear panel along another fold line;

top and bottom closure flaps hingedly joined to said front and rear panels along fold lines;

a closure tab joined to said first side panel along a fold line, said first side panel having a fold line extending diagonally from a lower edge of said closure tab towards an upper edge of said first side panel adjacent said front panel to define a triangular portion;

a spout dust flap hingedly joined to said first side panel by a fold line extending along an upper edge of said triangular portion, said dust flap including a curved edge which defines a notch, said triangular portion and said dust flap defining a pour spout; and a plurality of glue release dots on said rear panel adjacent an upper lateral edge thereof and positioned to engage said closure tab when said blank is folded to form a carton, said securement flap joined to said rear panel extending along only a portion of said rear panel and terminating adjacent said release dots and before an area engaged by said closure tab when the blank is folded to form a carton.

9. A die-cut blank as defined by claim 8 further including a glue repellant ink surrounding said glue release dots.

10. A die-cut blank as defined by claim 9 further including top and bottom dust flaps joined to top and bottom edges, respectively, of said second side panel along fold lines.

11. A die-cut blank as defined by claim 10 wherein said top and bottom closure flaps joined to said rear panel each define a plurality of die-cut glue perforation lines.

12. A die-cut blank as defined by claim 11 further including a rectangular dust flap joined to a lower edge of said first side panel along a fold line.

13. A die-cut blank as defined by claim 12 wherein a lateral edge of said rear panel adjacent said glue area is offset from the fold line joining said securement flap to said rear panel and said securement flap terminates at said offset lateral edge.

14. A die-cut blank as defined by claim 8 wherein said spout dust flap is coated with a glue repellant ink and further defines a glue release dot.

15. A die-cut blank as defined by claim 13 wherein said spout dust flap is coated with a glue repellant ink and further defines a glue release dot.

* * * * *